United States Patent [19]

Ohe

[11] 3,992,828

[45] Nov. 23, 1976

[54] COLLAPSIBLE PREFABRICATED HOUSE

[76] Inventor: Takao Ohe, 13-11, Yako 5-chome, Tsurumi, Yokohama, Kanagawa, Japan

[22] Filed: Mar. 23, 1976

[21] Appl. No.: 669,613

[52] U.S. Cl. ..... 52/69; 52/71; 52/79; 52/126; 52/143; 217/15

[51] Int. Cl.[2] ..... E04H 1/343

[58] Field of Search ..... 248/357; 217/15, 47; 52/71, 79, 126, 69, 64, 143

[56] References Cited

UNITED STATES PATENTS

| | | | |
|---|---|---|---|
| 687,807 | 12/1901 | Winter | 217/15 |
| 980,570 | 1/1911 | Sommerfeld | 217/15 |
| 2,015,176 | 9/1935 | Ebenhack | 52/69 |
| 2,473,076 | 6/1949 | Scheibner | 52/71 X |
| 3,103,709 | 9/1963 | Bolt | 52/79 X |
| 3,228,822 | 1/1966 | Norman | 52/615 |
| 3,517,962 | 6/1970 | Bassett | 52/64 X |
| 3,564,786 | 2/1971 | Baker | 52/79 |
| 3,570,698 | 3/1971 | Dougherty | 217/15 X |
| 3,713,259 | 1/1973 | Tkach | 52/126 X |
| 3,774,356 | 11/1973 | Philp | 52/71 X |
| 3,832,811 | 9/1974 | Briel, Jr. | 52/69 |
| 3,903,664 | 9/1975 | Doriel | 52/79 |

*Primary Examiner*—Price C. Faw, Jr.
*Assistant Examiner*—Leslie Braun
*Attorney, Agent, or Firm*—Fidelman, Wolffe & Waldron

[57] ABSTRACT

This invention relates to a collapsible prefabricated house comprising relatively short poles erected at each corner of a rectangular floor, supports for supporting a roof connected to each pole through means of a hinge or a pin attached to the top of the pole in a freely turnable manner, support brackets of a predetermined width fixed to the inner side of the top of each support so that, when the supports are turned, the supports are laid above the floor maintaining a predetermined space between them, front and rear panels fixed between the roof and the floor, and right and left side panels fixed between each support.

11 Claims, 11 Drawing Figures

COLLAPSIBLE PREFABRICATED HOUSE

SUMMARY OF THE INVENTION

This invention relates to a collapsible prefab house which can be used for various purposes, as for instance a field office in a construction field, a movable office, a temporary or movable shop, quarters in a construction field, a temporary house, a warehouse, a guardhouse and a lecture room.

Hitherto, a prefab house has been packed under the condition that components, such as floor, ceiling, roof, poles, wall, and frames, are possibly divided into small pieces, and the house has been assembled at a construction field. However, in the conventional method, many workers are required for the package and the carriage of the house, and moreover the assembly work takes a long time at a construction field, because enough machines and tools for the assembly are not usually provided in such a field. If a house is built in a sandy place or a marshy district, much labor and great expense are required in the foundation work for obtaining enough bearing force. This invention is to dissolve the above defects. The first object is to facilitate the package and the carriage of the collapsible house by previously engaging side wall panels and supports of the house in such a manner that they can be turned together toward and from the floor of the house.

The second object of the present invention is to provide a prefab house which can be easily assembled at a construction field.

Other objects and the feature of the present invention will be apparent from the embodiment described later.

Figure 1:
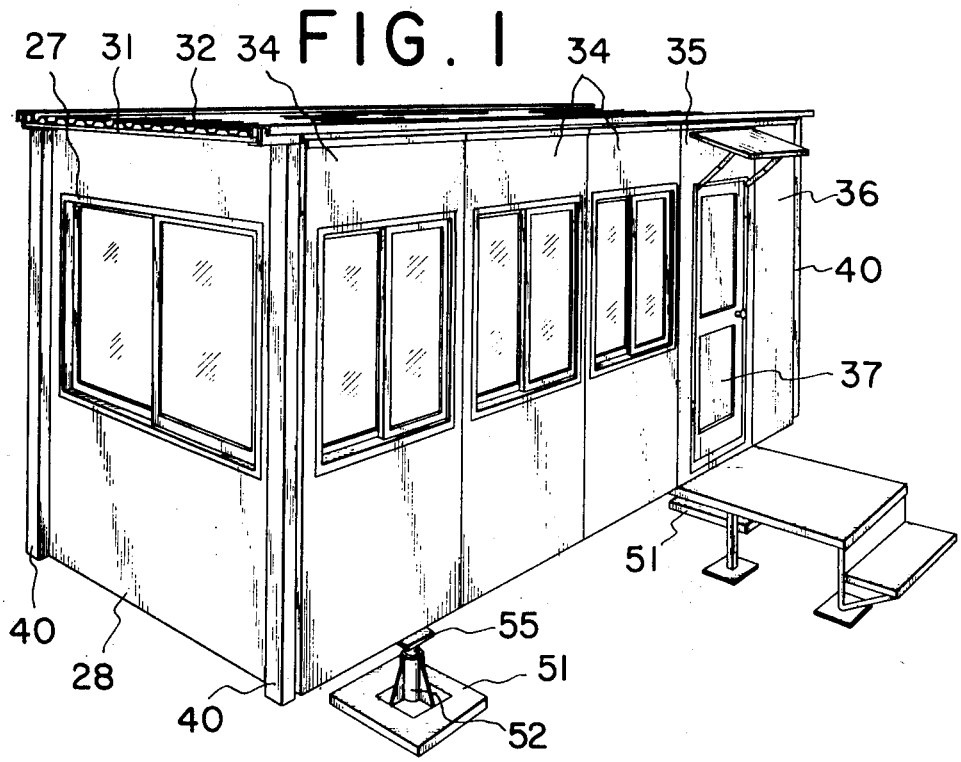
FIG. 1 is a perspective view of the prefab house of the present invention, which is singly used.

DETAILED DESCRIPTION OF THE INVENTION:

FIG. 1 is a perspective view of the prefab house of the present invention, which is singly used. Shapes of main components are shown in an exploded view of FIG. 2.

Reference numeral 21 designates a floor panel consisting of adiabatic material, a rectangular frame 23, latticed bars 22 and surface board of metal sheet and veneer board. Relatively short poles 24 of angle steel are erected at the four corners of the floor panel 21. A pivotal member, such as a hinge 25, is attached at the top of each pole 24. A support 26 of angle steel is connected to the pole 24 through means of the hinge 25 in such a manner that the support 26 can be turned inwards.

Figure 6:
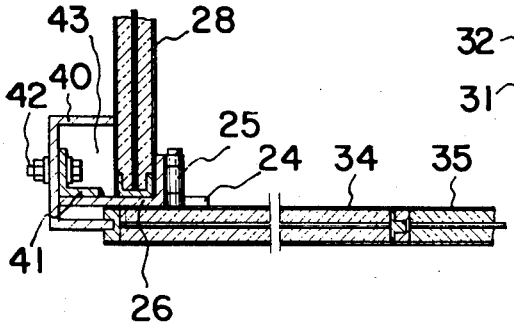
FIG. 6 is an enlarged sectional plan view showing how a front wall panel is engaged with a left side wall panel.

A total of four supports 26 are disposed at the corner of the floor panel 21 together with the poles 24. A side wall panel 28, having a sash 27 of aluminum or the like, is fixed between each support 26. FIG. 6 shows how the side wall panel 28 is joined to the support 26. The joining may be carried out by means of bolts, welding or the like. The side wall panel 28 consists of latticed bars, frame, adiabatic glass wool and surface board, such as veneer board and metal sheet.

A rectangular seat plate 29 is welded to the top of the support 26. A roof panel, which will be described later, is disposed on the seat plate 29. A support bracket 30 made of a channel steel is fixed at the inside of the support 26 and below the seat plate 29.

Figure 3:
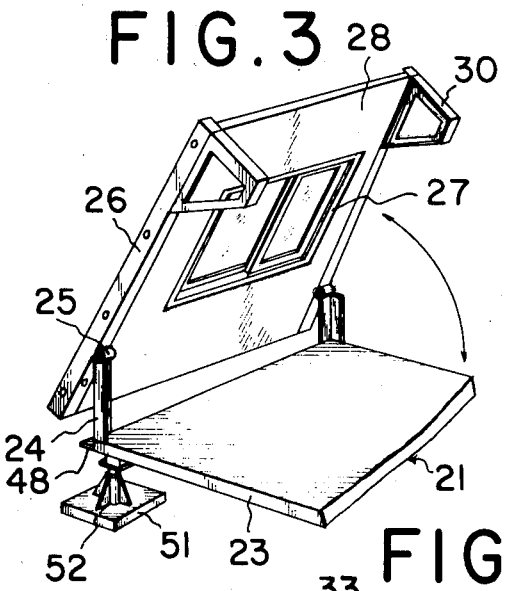
FIG. 3 is a partly omitted perspective view showing how the side wall panels and the supports are turned toward and from the floor.
Figure 4:
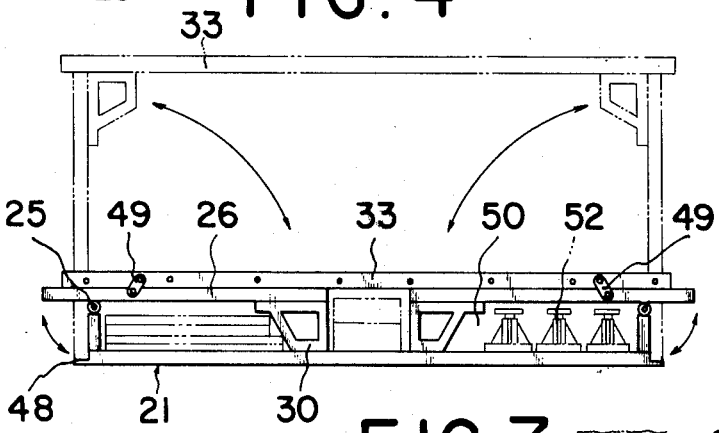
FIG. 4 is a front elevation view showing the collapsed condition of the prefab house.

The support bracket 30 is used to stably support the roof panel at the top of the support 26. Besides, when the support 26 is turned inwards together with the side wall panel 28 through means of the hinge 25, they can be retained in parallel with the floor panel 21 by means of the bracket 30. FIG. 3 is a perspective view showing how the supports 26 and the side wall panel 28 are turned toward the floor panel 21. FIG. 4 is a front elevation view showing the collapsed condition of the prefab house.

Figure 2:
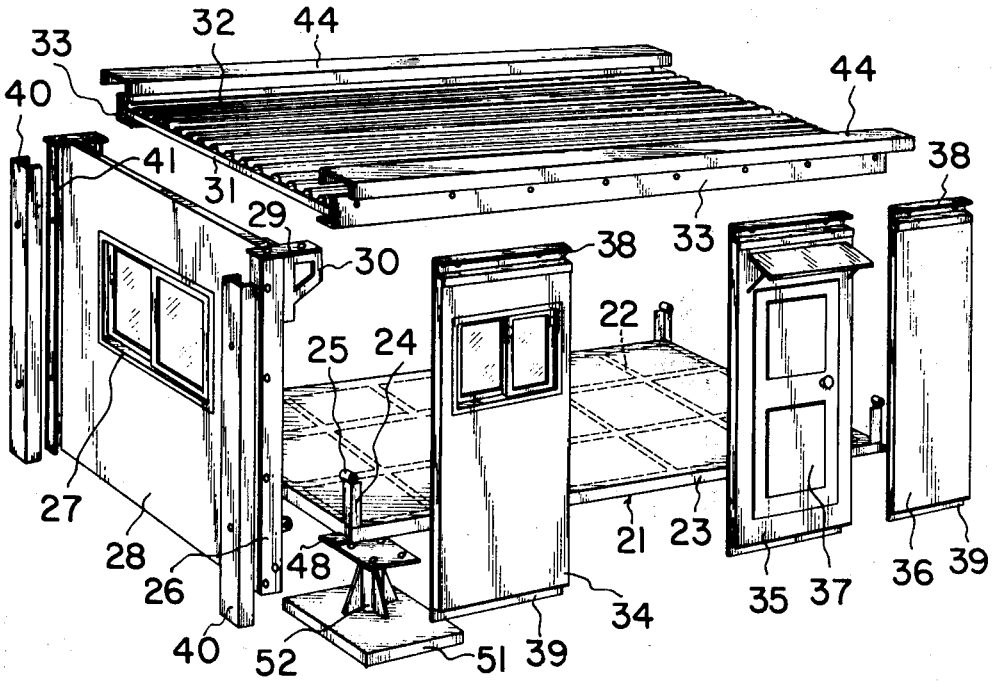
FIG. 2 is an exploded view showing the arrangement of the main parts of the prefab house of FIG. 1.

Reference numeral 31 designates the roof panel. The material and the structure of the roof panel are the same as those of the side wall panel 28. A water-proof board 32, such as a wave-shaped metal sheet or a sheet of synthetic resin, is disposed and fixed on the roof panel 31, or previously integrally joined to the roof panel 31. Beams 33 of angle steel, the section of which is an L-shape, are fixed to the front and rear edges of the water-proof board 32 over the full length, so that the roof panel 31 and the water-proof board 32 are supported by the bottom sides of the beams 33 at the front and rear ends thereof. The right and left ends of each beam 33 are disposed on the seat plates 29 fixed at the top of each support 26 as shown in phantom in FIG. 4. A bracket 48, fixed to each pole 24 at the outside thereof as shown in FIGS. 2 to 4, is to receive the bottom of the erected support 26 so as to possibly decrease the load subjected to the hinge 25.

Reference numerals 34, 35 and 36 are panels disposed at the front and the rear of the house, 34 is a panel with a sash, 35 is a panel with a door 37, and 36 is a wall panel. Any one of them has the same adiabatic and water-proof structure as the side wall panel 28 has. The said panels 34, 35 and 36 are fixed to the beams 33 and the floor frame 23 through means of channel or angle shaped metal fittings 38 and 39 at the top and the bottom thereof, and thereby the front and rear walls of the prefab house are formed. Any required number of any required type of panels can be optionally disposed at any required positions in accordance with the purpose of the house. The right and left side surfaces of each panel 34, 35 or 36 have concave and convex parts so that adjacent sides of each panel are engaged with each other so as not to cause any space between each panel but to obtain the air-tight and water-tight connection thereof. The connected condition is shown in FIG. 6.

Reference numeral 40 designates a channel-shaped side cover to cover the joined part of the support 26 and the panel 34 at each corner of the prefab house. FIG. 6 is an enlarged sectional plan view showing how the side cover 40 is attached at the corner of the house. The projected part of the angular support 26 is contained within the side cover 40. The channel-bottom of the side cover 40 is fastened to an angular attachment 41 fixed to the projected part of the support 26 by means of a bolt 42. One side of the cover 40 is pushed against the outer surface of the side wall panel 28 and another side is pushed against the left side surface of the panel 34 disposed at the front of the house. Therefore the joint of each corner is reinforced and good outer appearance is obtained.

As shown in FIG. 6, the side cover 40 has a space 43. This space 43 can be optionally used for a feed or drain pipe, a service wire of electricity or the like.

Figure 5:
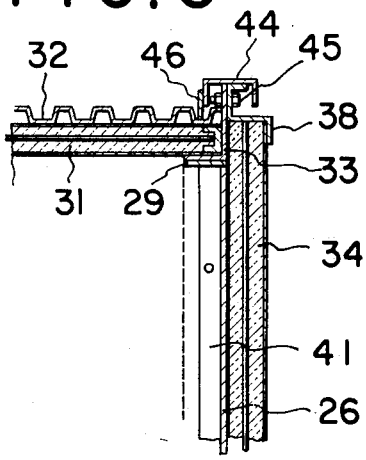
FIG. 5 is an enlarged sectional elevation view seen from the left side showing how a roof panel is engaged with a front wall panel.

FIG. 5 is an enlarged sectional elevation view showing how the roof panel 31, the water-proof board 32, the beam 33, the front panel 34 and the support 26 are joined together. Reference numeral 44 designates a roof cover which is fixed to the projected edge of the beam 33 and the upper edge of the metal fittings 38, fastened to the beam 33 by means of a bolt 45, over the full length in order to prevent rainwater from entering. Reference numeral 46 designates a skirting board attached at the front or rear surface of the roof cover 44 as required, in contact with the upper surface of the water-proof board 32.

Figure 7:
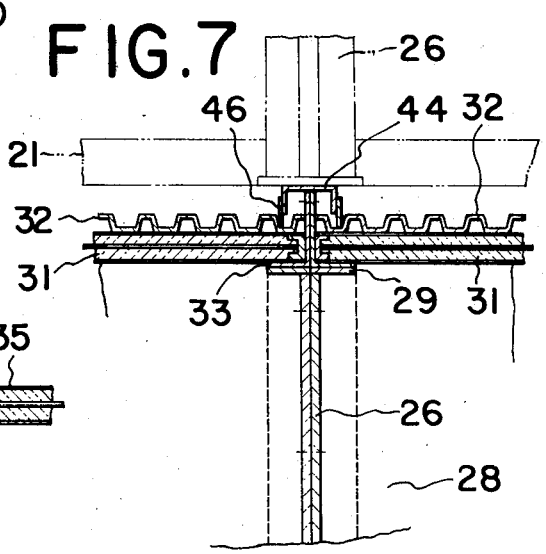
FIG. 7 is an enlarged sectional elevation view seen from the left side showing how two unit houses are connected together.

FIG. 7 is an enlarged sectional elevation view showing how two unit houses are joined together. One unit house is disposed in front of another unit house, and two adjacent supports 26 are fastened to each other by means of bolts or the like. The adjacent beams 33 are also fastened to each other by the similar means. Water-proof processing is performed at the joined part thereof. Moreover the roof cover 44 is disposed at the top of the joined part.

Figure 11:
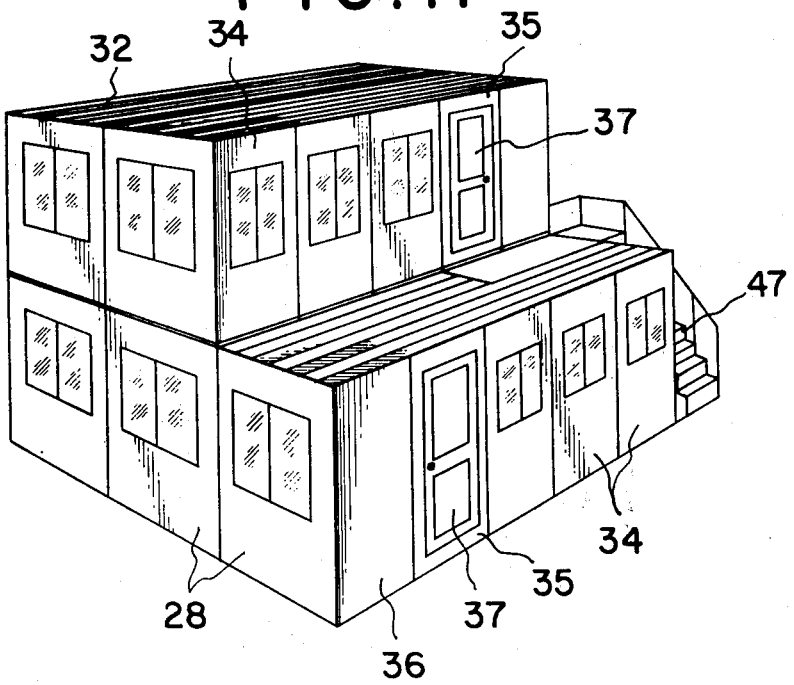
FIG. 11 is a brief perspective view of five unit houses connected together constituting a two-story house.

The two-dotted line of FIG. 7 shows an example that other two unit houses joined together are disposed on the said two unit houses (refer to FIG. 11). In this case, special metal fittings may be optionally used.

Figure 8:
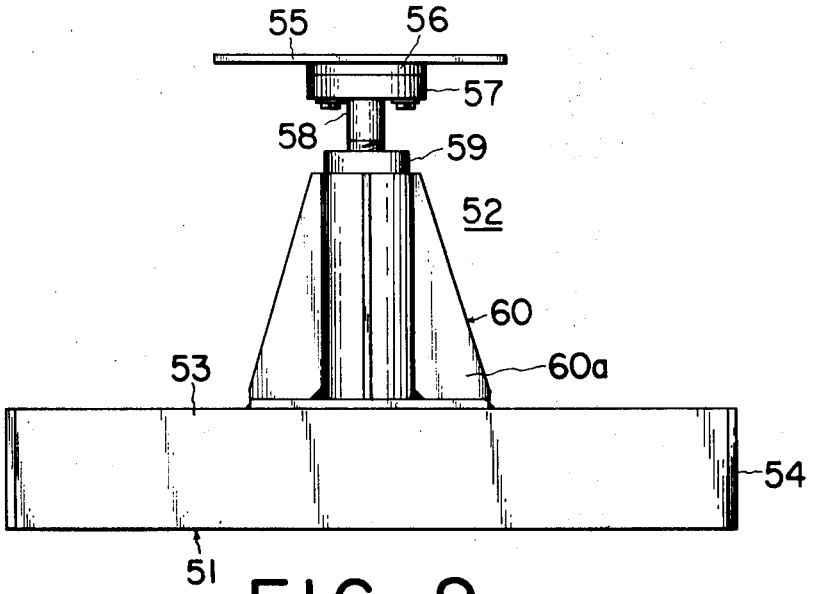
FIG. 8 is an enlarged front elevation view of a foundation jack stand for use in the establishment of the prefab house.
Figure 9:
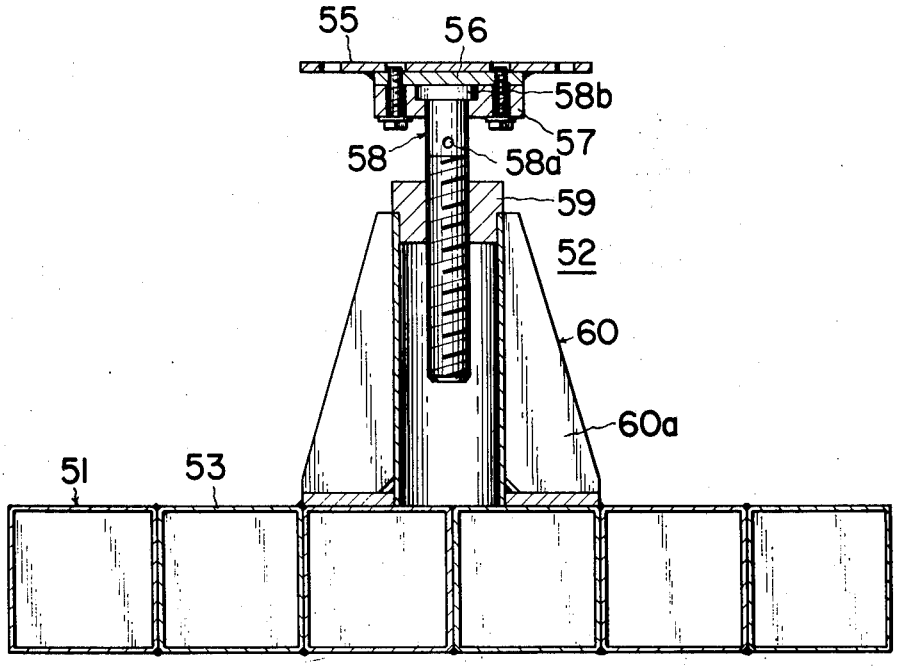
FIG. 9 is a central sectional elevation view of the jack stand of FIG. 8.

FIGS. 8 and 9 are respectively a front elevation view and a central sectional elevation view of a foundation jack stand for use in the establishment of the prefab house. The jack stand comprises a bottom seat 51 and a jack 52 fixed at the center of the seat 51 by means of welding. The seat 51 consists of a plurality of square tubes 53, made of steel sheet, arranged in parallel with each other and connected together at adjacent ends by means of welding. Two end plates 54 are welded to both open ends of the said seat 51 so as to seal them, and thereby the connection between each steel tube is reinforced.

The jack 52 fixed on the seat 51 consists of a main body jack 60 having ribs 60*a* on the outer periphery thereof and a seat plate 55 for fixing and supporting the house. The main body jack 60 has a nut 59 at the top thereof. The nut 59 is receiving a screw 58 in such a manner that the screw 58 can freely descend and ascend.

The screw 58 is provided with a hole 58*a*, to turn the screw 58, at the upper part and a screw head 58*b* at the top. The screw head 58*b* is fixed to a screw receiver 56 through a screw head cover 57 by means of bolts or the like. The seat plated 55 is welded to the upper surface of the screw receiver 56.

As shown in FIGS. 1 and 2, a plurality of foundation jack stands constructed as abovementioned are disposed at predetermined positions in order to support the prefab house. The seat plates 55 are fixed to the lower surfaces of the floor panel of the house so as to maintain the level of the house by the vertical adjustment of the jack.

The bottom seat of the jack stand is made of a plurality of square tubes of steel sheet. Therefore the jack stand is light and easy to operate. The adjacent ends of the square steel-tubes are welded, and the open ends of the steel-tubes are sealed with the end plates so as to integrally connect the open ends. Accordingly, the jack stand has enough durability in strength as the foundation of a construction. Since the hollow part of the steel tube is sealed by means of the end plate, enough bearing force can be obtained even in a sandy place and a marshy district. The joints between each steel tube are effective to prevent the sideslip of the bottom seat of the jack stand.

Figure 10:
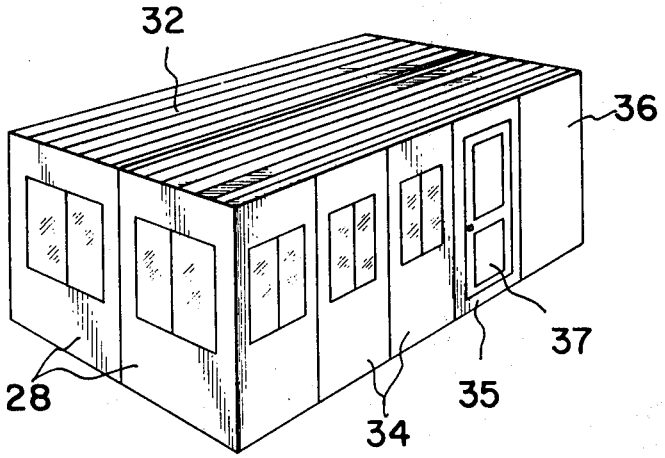
FIG. 10 is a brief perspective view of two unit houses connected together.

FIG. 10 is a brief perspective view showing two unit houses connected together by the method shown with the solid line in FIG. 7. In this case, the panels between each unit house are not necessarily attached, and thereby any partition can be omitted within the connected house.

FIG. 11 is a brief perspective view showing five unit houses connected together by the method shown with the solid line and the two-dotted line in FIG. 7. This is a two-story construction. A step 47 can be optionally disposed outside or inside in accordance with the purpose of the construction.

Hereinafter how to collapse, carry and assemble the prefab house of the present invention will be described according to the accompanying drawings.

The side wall panels 28 are previously fixed between each support 26. They are connected to the poles 24 erected at each corner of the floor in a freely turnable manner through means of the hinges 25 attached at the tops thereof (refer to FIG. 3). It is possible to connect the support 26 to the pole 24 through means of a pin (not shown in the drawing), which can be easily inserted and removed, instead of the hinge 25. It is also possible to fix the side wall panels 28 between the supports 26 at the construction field.

The side wall panel 28 is turned toward the floor panel 21 together with the suppports 26 and laid horizontally maintaining a certain space 50 between the side wall panel 28 and the floor panel 21 by means of the brackets 30, as shown in FIG. 4. The roof panel 31, the beams 33 and the roof covers 44 are disposed on the laid wall panels 38 by use of a crane or the like, and the jack stands 52, the front and rear panels, other various parts for the assembly and annexed tools are disposed in the space 50, so that the whole parts of the house are united and packed into one package. Reference numeral 49 designates coupling members to connect the beams 33 and the supports 26 together by means of bolts or pins in order to prevent the package from breaking.

Since the prefab house of the present invention is packed into a rectangular parallelepiped having horizontal upper and lower surfaces, a plurality of packages can be effectively piled up on a track. If the support 26 is connected to the pole 24 by means of a pin, it is possible that, after the support 26 is turned toward the floor so as to be laid above the floor, the pin is taken from the support and the outer end of the support is pushed inwards so that the package is formed into a more complete parallelpiped.

In order to establish the prefab house, a predetermined number of jack stands 52 are disposed at the required positions in accordance with the shape of the floor panel 21. The floor panel 21 of the collapsed house is disposed on the jack stands. The seat plates 55 of the jack stands are fixed to the lower surface of the floor panel 21 and the adjustment is performed so as to horizontally support the floor panel.

In order to assemble the house, the roof panel 31 laid above the floor panel is lifted, the supports 26 are erected, and the roof panel 31 is fixed on the tops of the supports 26 as shown with the two-dotted line in FIG. 4. If the hinges 25 or pins are removed from the supports in the collapsed condition, they should be previously attached to the supports so that the supports can be turned outwardly. If the side wall panels 28 are not fixed between the supports in the collapsed condition, they should be fixed before disposing the roof panel on the tops of the supports.

The front and rear panels 34, 35 and 36 are fixed between the beams 33 and the floor panel 21, and last the side covers 40 and the roof covers 44 are attached.

In case that a plurality of unit houses of the present invention are joined together to build a bigger house, they are connected as shown in FIGS. 10 and 11 by the method shown with the solid line and the two-dotted line in FIG. 7.

We claim;

1. A collapsible prefab house comprising relatively short poles erected at each corner of a rectangular floor panel, supports for supporting a roof panel connected to each pole from the outside through means of a pivotal member in a freely turnable manner, support brackets of a predetermined width fixed to the inner side of the top of each support so that, when the supports are turned toward the floor panel, the supports are laid above the floor panel maintaining a predetermined space between them, front and rear panels fixed between the roof panel and the floor panel, right and left side panels fixed between each support, and a plurality of foundation jack stands disposed below the floor panel so as to horizontally support the floor panel.

2. A collapsible prefab house, as claimed in claim 1, in which a pivotal member through which each support is connected to each pole is a hinge.

3. A collapsible prefab house, as claimed in claim 1, in which a pivotal member through which each support is connected to each pole is a pin which is inserted through the top of the fixed pole and the support in a freely removable manner.

4. A collapsible prefab house, as claimed in claim 1, in which the turnable support is an L-shaped sectional angle steel.

5. A collapsible prefab house, as claimed in claim 1, in which the side panels are previously fixed between each support so that the supports are turned toward the floor panel together with the side panels.

6. A collapsible prefab house, as claimed in claim 1, in which the foundation jack stand comprises a bottom seat, which consists of a plurality of square tubes of steel sheet connected and welded together at adjacent ends and end plates welded to the open ends of the steel tubes, and a screw jack fixed at the center of the bottom seat in such a manner that a seat plate provided at the top of the jack can freely descend and ascend.

7. A collapsible prefab house comprising relatively short poles erected at each corner of a rectangular floor panel, supports for supporting a roof panel connected to each pole from the outside through means of a pivotal member in a freely turnable manner, support brackets of a predetermined width fixed to the inner side of the top of each support so that, when the supports are turned toward the floor panel, the supports are laid above the floor panel maintaining a pedetermined space between them, front and rear panels fixed between the roof panel and the floor panel, and right and left side panels fixed between each support.

8. A collapsible prefab house, as claimed in claim 1, in which a pivotal member through which each support is connected to each pole is a hinge.

9. A collapsible prefab house, as claimed in claim 1, in which a pivotal member through which each support is connected to each pole is a pin which is inserted through the top of the fixed pole and the support in a freely removable manner.

10. A collapsible prefab house, as claimed in claim 1, in which the turnable support is an L-shaped sectional angle steel.

11. A collapsible prefab house, as claimed in claim 1, in which the side panels are previously fixed between each support so that the supports are turned toward the floor panel together with the side panels.

* * * * *